US006374074B1

(12) United States Patent
Oono

(10) Patent No.: US 6,374,074 B1
(45) **Date of Patent: *Apr. 16, 2002**

(54) CLEANING APPARATUS AND CLEANING METHOD

(75) Inventor: Michiteru Oono, Yokohama (JP)

(73) Assignee: Toshiba Tec Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/501,598

(22) Filed: Feb. 10, 2000

(51) Int. Cl.[7] ..... G03G 21/00
(52) U.S. Cl. ..... 399/350; 399/358
(58) Field of Search ..... 399/343, 356, 399/350, 351, 358, 359, 360, 349

(56) References Cited

U.S. PATENT DOCUMENTS

| | | | | | |
|---|---|---|---|---|---|
| 4,252,433 | A | * | 2/1981 | Sullivan | 399/349 X |
| 4,252,434 | A | * | 2/1981 | Nakamura et al. | 399/358 |
| 4,297,021 | A | * | 10/1981 | Tani et al. | 399/358 |
| 4,323,306 | A | * | 4/1982 | Ito et al. | 399/358 |
| 4,364,660 | A | | 12/1982 | Oda | |
| 4,501,620 | A | | 2/1985 | Oda | |
| 4,639,123 | A | * | 1/1987 | Adachi et al. | 399/351 |
| 4,875,081 | A | * | 10/1989 | Goffe et al. | 399/343 |
| 5,091,753 | A | * | 2/1992 | Slapelis | 399/349 |
| 5,517,294 | A | * | 5/1996 | Ogiri et al. | 399/351 |
| 5,543,906 | A | * | 8/1996 | Kanda | 399/350 |
| 5,617,194 | A | * | 4/1997 | Morishita et al. | 399/349 |
| 5,890,048 | A | * | 3/1999 | Hirota | 399/358 |

FOREIGN PATENT DOCUMENTS

JP 63-23552 5/1998

* cited by examiner

*Primary Examiner*—Sandra Brase
(74) *Attorney, Agent, or Firm*—Foley & Lardner

(57) ABSTRACT

A cleaning apparatus comprising a scraping member for scraping a developing agent left on a rotatable image carrier by brining a tip portion of the scraping member in contact with the rotatable image carrier, a receipt member located at an upstream side of the scraping member in a rotation direction of the image carrier, for receiving the developing agent scraped by the scraping member by bringing a tip portion of the scraping member in contact with the image carrier, and a rotational body for feeding and recovering the developing agent received by the receipt member by rotating the developing agent in a predetermined direction, in which, assuming that a rotation center of the image carrier is 01, a rotation center of the rotational body is 02, a contact point of the image carrier in contact with the scraping member is A, a contact point of the image carrier in contact with the receipt member is B, and further an angle between a line connecting the center 01 to the point A and a line connecting the center 01 to the center 02 is represented by a, and an angle between the line connecting the center 01 to the point A and a line connecting the center 01 and point B is represented by b, the rotational body is placed at a position satisfying an equation as to the angle a:

$$0 \leqq a \leqq b/2.$$

14 Claims, 5 Drawing Sheets

CLEANING APPARATUS AND CLEANING METHOD

BACKGROUND OF THE INVENTION

The present invention relates to a cleaning apparatus and cleaning method for cleaning a photo-sensitive drum of, for example, an electrophotographic copying machine.

In the image forming apparatus of the electrophotographic copying machine or the like, a toner image corresponding to image data is formed on a photosensitive drum, and then, the toner image thus formed is transferred onto a paper sheet by a transfer charger. The toner left on the photosensitive drum after the toner image transfer is removed by a cleaning apparatus.

The cleaning apparatus has a cleaning blade. The toner left on the photosensitive drum is scraped by the tip or edge portion of the cleaning blade which is allowed in contact with the photosensitive drum. The toner scraped is captured by a recovery blade. The captured toner is fed to a recovery section with the aid of a paddle-form or a roller-form rotational body having a magnet.

In the image forming apparatus, the cleaning apparatus is placed at a side or above the photosensitive drum so as to face it.

When the cleaning apparatus is placed at a side of the photosensitive drum so as to face it, the toner scraped off by the tip portion of the cleaning blade falls under its own weight. No problem is posed in this case.

However, in the case where the cleaning apparatus is placed above the upper surface of the photosensitive drum so as to face it, the toner is more or less accumulated near the tip or edge portion of the cleaning blade, lowering a scraping performance (cleaning performance) of the cleaning blade.

It is possible to reduce the toner accumulation by enhancing a magnetic force of the magnet of the rotational body. In this case, however, an expensive material (ferrite etc.) having a high magnetic property must be used. As a result, the cost increases.

BRIEF SUMMARY OF THE INVENTION

The present invention was made in view of the aforementioned circumstances. An object of the present invention is to provide a cleaning apparatus and cleaning method providing a good cleaning performance by reducing accumulation of a developing agent on a tip portion of the scraping member without requiring an expensive magnet.

A cleaning apparatus according to the present invention comprises:

a scraping means for removing a developing agent left on a rotatable image carrier, a tip portion of the scraping member being in contact with the rotatable image carrier;

a receiving means located at an upstream side of the scraping member in a rotation direction of the image carrier, for receiving the developing agent by the by bringing a tip portion of the scraping member in contact with the image carrier; and a rotational body for feeding and recovering the developing agent received by the member by rotating the developing agent in a predetermined direction;

in which, assuming that a rotation center of the image carrier is 01, a rotation center of the rotational body is 02, a contact point of the image carrier in contact with the scraping member is A, a contact point of the image carrier in contact with the receipt member is B, and further an angle between a line connecting the center 01 to the point A and a line connecting the center 01 to the center 02 is represented by a; and an angle between the line connecting the center 01 to the point A and a line connecting the center 01 and point B is represented by b, the rotational body is placed at a position satisfying an equation as to the angle a:

$$0 \leqq a \leqq b/2.$$

A cleaning apparatus according to the present invention comprises:

a scraping member for scraping a magnetic developing agent left on a rotatable image carrier by bringing a tip portion of the scraping member in contact with the rotatable image carrier;

a receipt member located at an upstream side of the scraping member in a rotation direction of the image carrier, for receiving the magnetic developing agent scraped by the scraping member by bringing a tip portion of the scraping member in contact with the image carrier; and a magnetic rotational body for feeding and recovering the magnetic developing agent received by the receipt member by rotating the magnetic developing agent in a predetermined direction;

wherein, assuming that a rotation center of the image carrier is 01, a rotation center of the magnetic rotational body is 02, a contact point of the image carrier in contact with the scraping member is A, a contact point of the image carrier in contact with the receipt member is B, and further an angle between a line connecting the center 01 to the point A and a line connecting the center 01 to the center 02 is represented by a; and an angle between the line connecting the center 01 to the point A and a line connecting the center 01 and point B is represented by b, the magnetic rotational body is placed at a position satisfying an equation as to the angle a:

$$0 \leqq a \leqq b/2.$$

A cleaning method according to the present invention comprises the steps of scraping a developing agent left on a rotatable image carrier by a scraping member by bringing a tip portion of the scraping member in contact with the rotational image carrier;

receiving the developing agent scraped by the scraping member, by a receipt member which is positioned at an upstream side of the scraping member in a rotational direction of the image carrier by bringing a tip portion of the receipt member in contact with the image carrier; and recovering the developing agent received by the receipt member by feeding in a predetermined direction with the aid of the rotational body, wherein, assuming that a rotation center of the image carrier is 01, a rotation center of the rotational body is 02, a contact point of the image carrier in contact with the scraping member is A, a contact point of the image carrier in contact with the receipt member is B, and further an angle between a line connecting the center 01 to the point A and a line connecting the center 01 to the center 02 is represented by a; and an angle between the line connecting the center 01 to the point A and a line connecting the center 01 and point B is represented by b, the rotational body is placed at a position satisfying an equation as to the angle a:

$$0 \leqq a \leqq b/2.$$

DETAILED DESCRIPTION OF THE INVENTION

Figure 1:
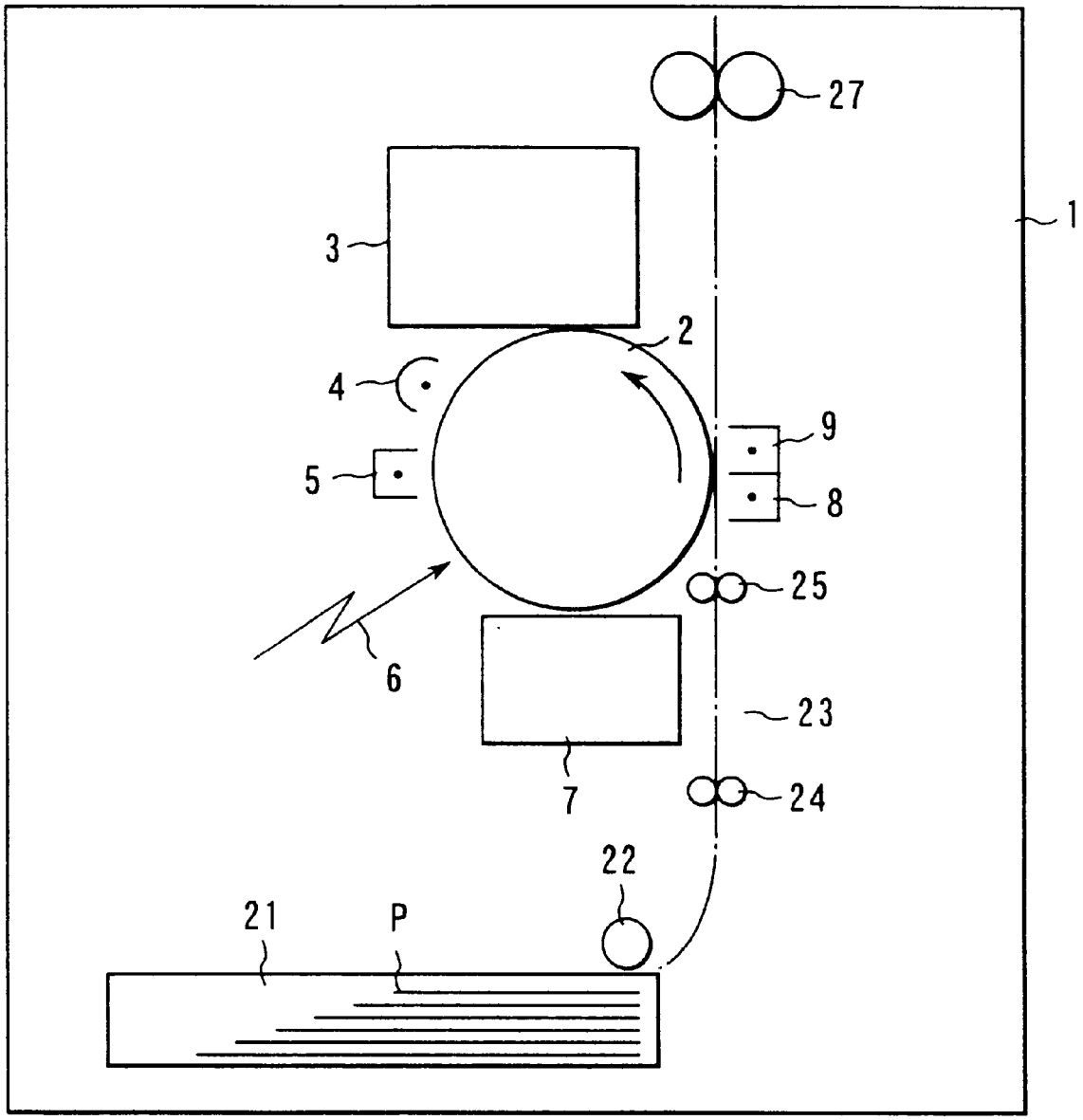
FIG. 1 is a schematic view showing of a structure of an electrophotographic copying machine according to an embodiment of the present invention.

Now, the present invention will be explained with reference to embodiments shown in the drawings.

FIG. 1 is a schematic view of an electro-photographic copying machine as an image forming apparatus according to an embodiment of the present invention.

In the figure, reference numeral 1 is a copying machine main body. At near the center portion of the copying machine main body 1, a photosensitive drum 2 serving as an image carrier is rotatably arranged. Over the upper surface portion of the photosensitive drum 2, a cleaning apparatus 3 for removing a magnetic toner left on the photosensitive drum 2 is arranged so as to face the photosensitive drum 2.

At one of the side portions of the photosensitive drum 2, a discharging charger 4 for removing a surface potential of the photosensitive drum 2, an electrifying charger 5 for charging the surface of the photosensitive drum 2 with a predetermined potential, and a light exposure portion 6 for forming a toner image corresponding to an original image, are arranged so as to face the photosensitive drum 2. Under a lower surface of the photosensitive drum 2, a developing apparatus 7 is arranged so as to face it. The developing apparatus 7 plays a role in supplying a magnetic toner serving as a developing agent to the toner image formed on the photosensitive drum 2 to develop the toner image. At the other side of the photosensitive drum 2, a transfer charger 8 for transferring the toner image onto the paper sheet, and a removing charger 9 for removing the paper on which the toner image is transferred, from the photosensitive drum 2, are arranged so as to face it.

A paper sheet feed cassette 21 for storing paper sheets P is arranged at a lower portion in the copying machine main body 1, A paper feed roller 22 for feeding paper sheets is arranged at one side of the upper portion of the paper feed cassette 21. The paper sheet P supplied from the paper feed roller 22 is fed along a transfer path 23. Along the transfer path 23, arranged are a feed roller pair 24 for feeding the paper sheet P while sandwiching it therebetween, a resist roller pair 25 for aligning the paper sheet P, the transfer charger 8 and removing charger 9, and a fixing unit 27 for fixing the toner image transferred onto the paper sheet P. In the image forming step, the surface of the photosensitive drum 2 is charged by the electrifying charger 5. Then, an electrostatic latent image corresponding to an original image is formed by the light exposure member 6 on the surface of the photosensitive drum 2. The electrostatic latent image is transferred to the developing apparatus 7 by the rotation of the photosensitive drum 2 and then developed upon supplying a magnetic toner from the developing apparatus 7, with the result that a magnetic toner image is developed.

On the other hand, in this case, a paper sheet P is fed by the rotation of the paper feed roller 22. The paper sheet P is fed by the transfer roller pair 24 while being sandwiched therebetween. The paper sheet P, after being aligned by the resist roller pair 25, is sent between the photosensitive drum 2 and the transfer charger 8, in which the magnetic toner image formed on the photosensitive drum 2 is transferred onto the paper P. The paper sheet P having the toner image transferred thereon is removed from the photosensitive drum 2 by the function of the removing charger 9 and further sent to the fixing unit 27. The transferred toner image is fixed onto the paper sheet P in the fixing unit 27 and then discharged into a discharge section (not shown).

When the magnetic toner image formed on the photosensitive drum 2 is transferred, the magnetic toner image is not transferred onto the paper sheet P in its entirety and partly left on the photosensitive drum 2. The magnetic toner left on the photosensitive drum 2 is removed from the photosensitive drum 2 by the cleaning apparatus 3 as specifically described later. After the surface of the photosensitive drum 2 is cleaned, the surface potential is removed by the discharging charger 4. In this manner, an image forming process is completed.

Figure 2:
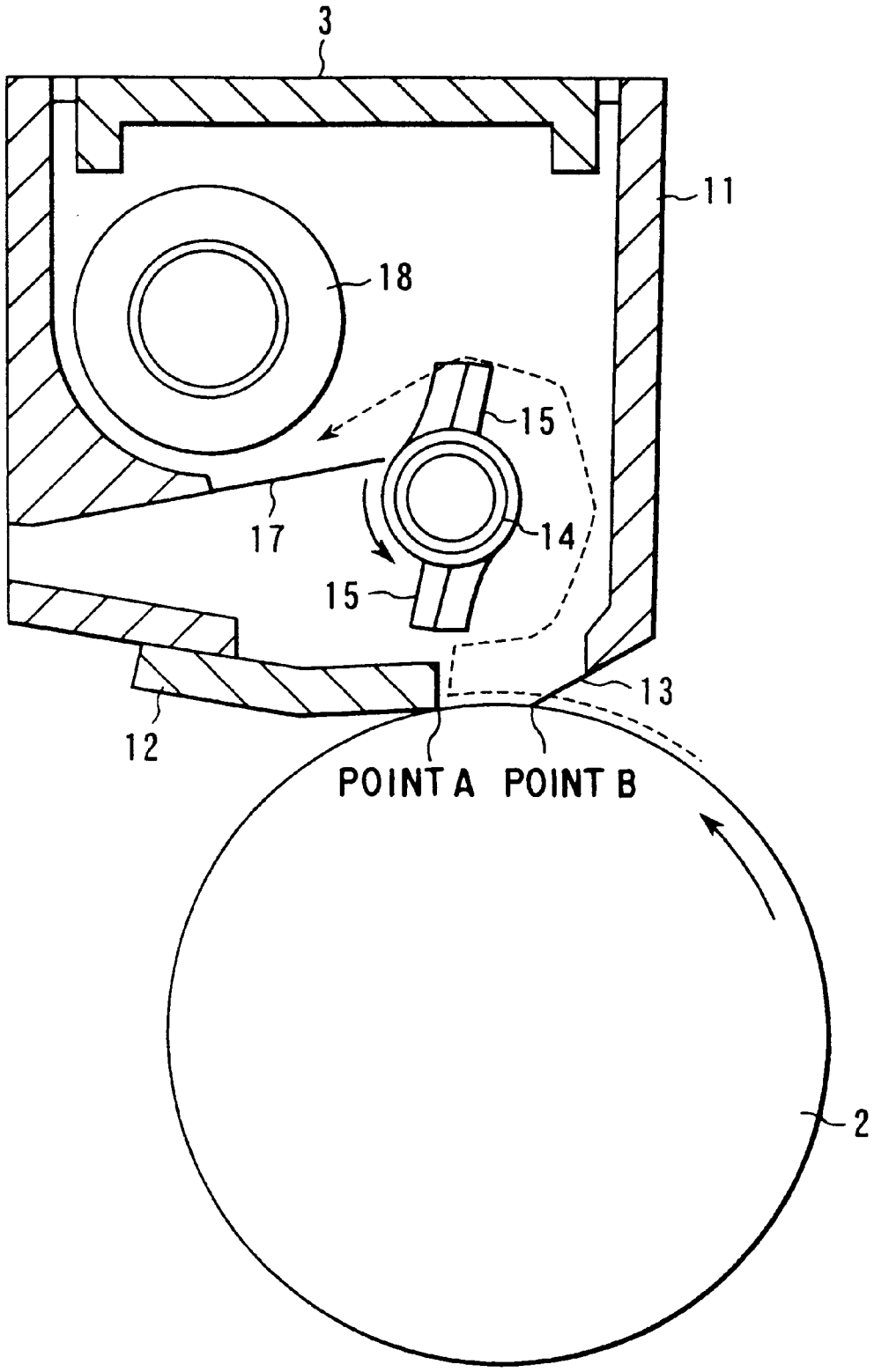
FIG. 2 is a view showing a structure of a cleaning apparatus for cleaning a photosensitive drum.

FIG. 2 is a view showing a structure of the cleaning apparatus 3 mentioned above.

The cleaning apparatus 3 has a casing 11. At the bottom of the casing 11, a cleaning blade 12 and a recovery blade 13 are arranged as a scraping arrangement. The tip portion of the cleaning blade 12 is brought in contact with an upper surface of the photosensitive drum 2. The recovery blade 13 is arranged at an upstream side in a rotation direction of the photosensitive drum and its tip portion is brought in contact with the upper surface portion of the photosensitive drum 2.

In an inner bottom portion of the casing 11, a feed paddle 14 as a rotational body is arranged. The feed paddles feed the toner scraped by the tip portion of the cleaning blade 12, upward, thereby recovering the toner. The feed paddle 14 is arranged above at a distance of about 3 mm from the upper surface of the photosensitive drum 2 and rotated in a reverse direction to the photosensitive drum 2. The feed paddle 14 is equipped with a magnet 15 having a magnetic force of about 400–500 gausses. The N-S direction of the magnetic force of the magnet 15 is applied in parallel to a circumference direction of the paddle.

Furthermore, in the casing 11, a scraper 17 is arranged for removing the toner fed by the transfer paddle 14. A discharge auger 18 is arranged above the scraper 17 for unloading the toner removed by the scraper 17.

At the time of cleaning, the toner left on the photosensitive drum 2 is scraped by the tip portion of the cleaning blade 12 with the rotation of the photosensitive drum 2. The toner scraped is captured by the recovery blade 13. The toner thus captured is fed upward by the rotation of the feed paddle 14 as indicated by a broken-line arrow and recovered with the aid of its magnetic force. The toner to be recovered is removed from the feed paddle 14 by the scraper 17 and unloaded by the rotation of the unloading auger.

Figure 3:
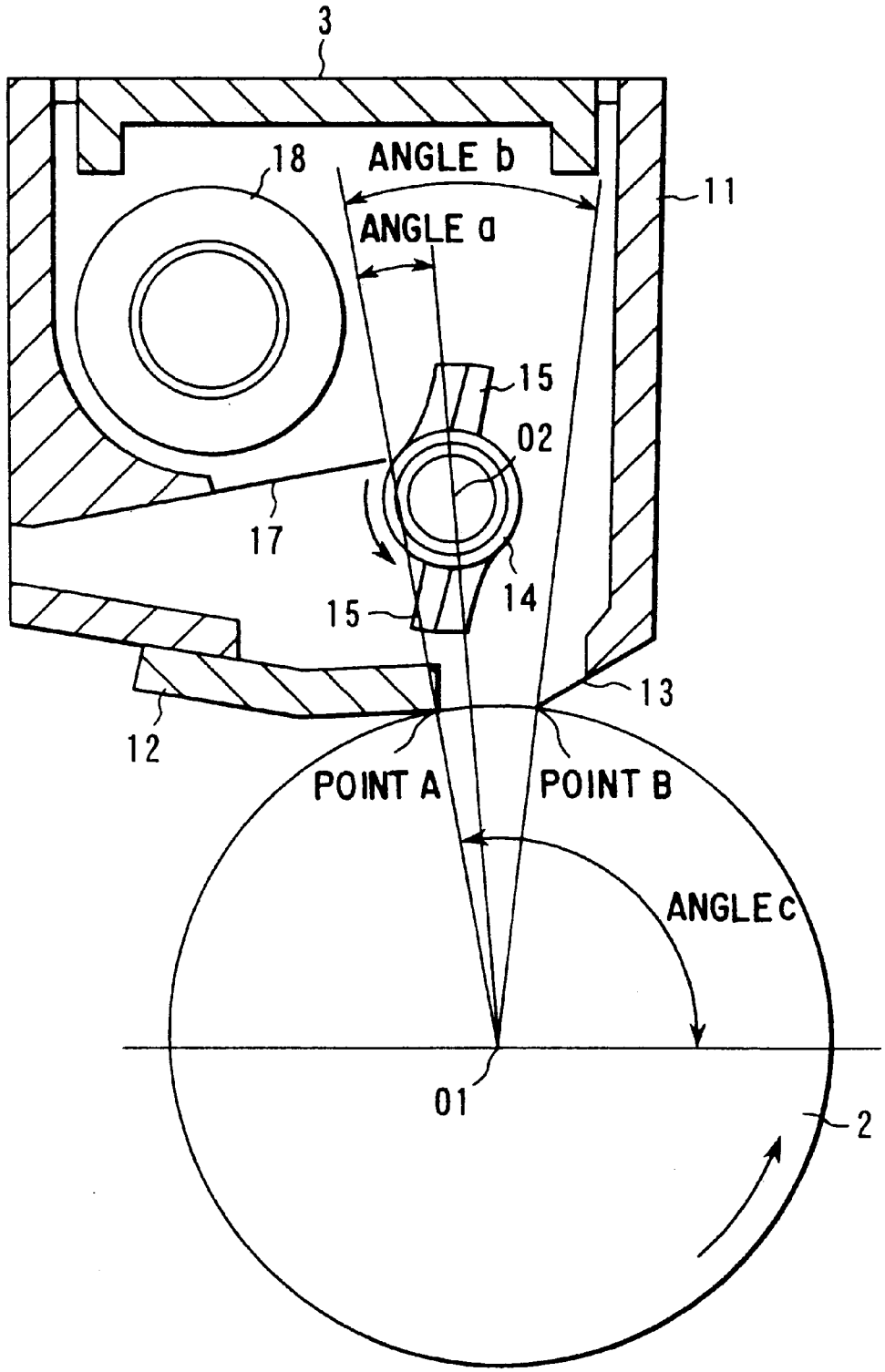
FIG. 3 is a view showing an arrangement of the magnetic rotational body of the cleaning apparatus.

FIG. 3 is a view for use in explaining an arrangement of the feed paddle 14.

In the FIG. 3, point A is a contact point at which the photosensitive drum 2 is in contact with the cleaning blade 12. Point B is also a contact point at which the photosensitive drum 2 is in contact with the recovery blade 13.

Assuming that the angle between a line connecting a center 01 of the photosensitive drum 2 to point A and a line connecting the center 01 of the photosensitive drum 2 to a center 02 of the feed paddle 14 is represented by reference symbol a; the angle between the line connecting the center 01 of the photosensitive drum 2 and point A and a line connecting the center 01 of the photosensitive drum 2 to point B is represented by reference symbol b; and the angle between the line connecting the center 01 of the photosensitive drum 2 to point A and the horizontal line passing through the center 01 of the photosensitive drum 2 is represented by a reference symbol c, the feed paddle 14 is placed at a position satisfying the following equation as to the angle a;

$$0 \leqq a \leqq b/2.$$

Furthermore, the cleaning blade 12 is placed in contact with the photosensitive drum 2 at an upper side of the center line passing through the center 01 of the photosensitive drum 2.

Figure 4:
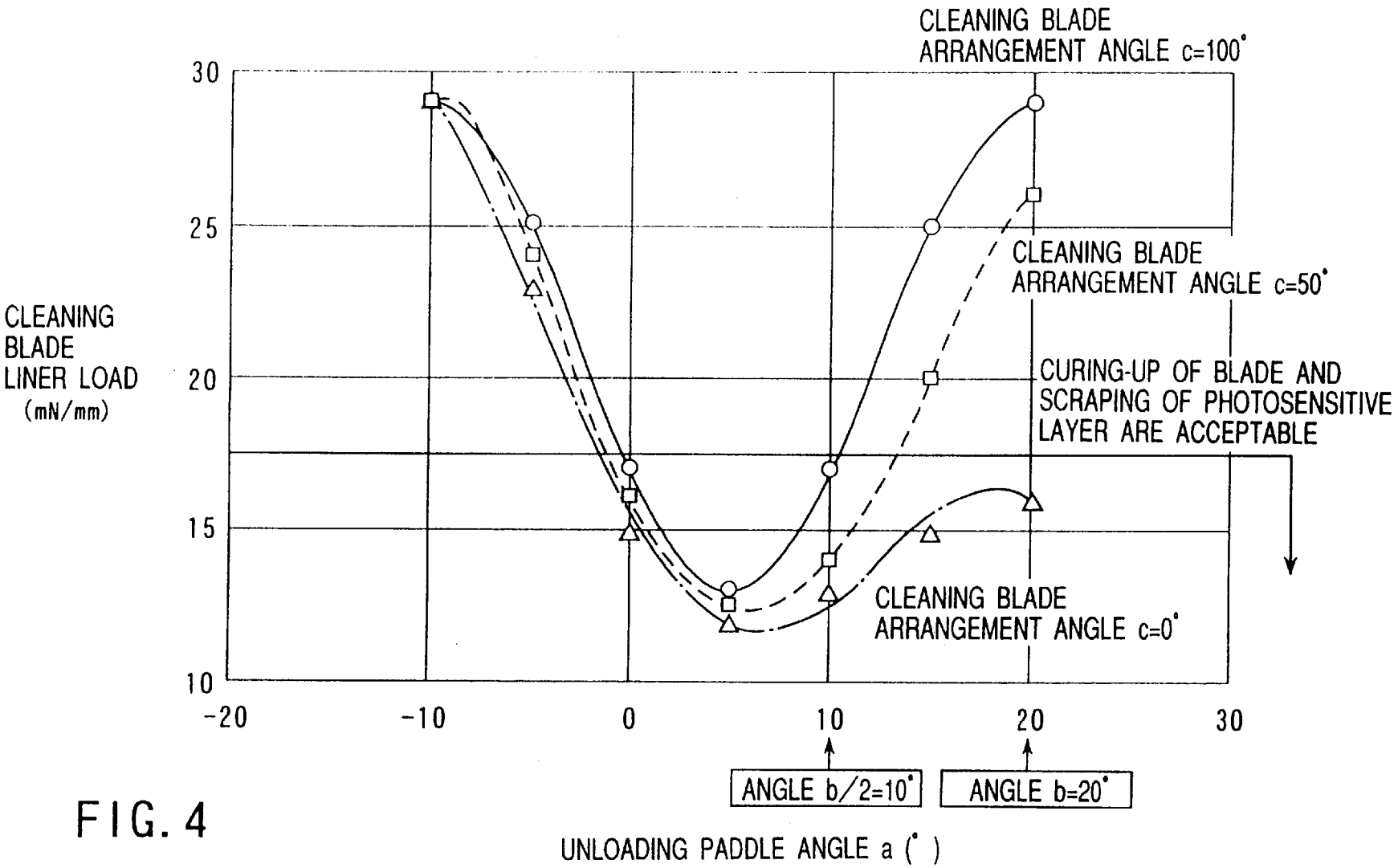
FIG. 4 is a graph showing the relationship between the position of the magnetic rotational body and the linear load of the cleaning blade.

FIG. 4 is a graph showing the relationship between the arrangement angle a of the feed paddle and marginal linear load of the cleaning blade.

In FIG. 4, a horizontal axis represents an angle a of the feed paddle. The vertical axis represents a loading linear load of the cleaning blade 12.

In the figure, each of plots shows a marginal linear load point (lowermost limit) at which cleaning can be made under its own condition.

The feed paddle 14 has a diameter of 12 mm. The shaft center of the feed paddle is arranged so as to have a gap of 3 mm between the tip portion thereof and the photosensitive drum 2.

The plots are separated by each of cleaning blade arrangement angles c, 100° indicated by a solid line, 50° indicated by a broken line, 0° indicated by a dot and dash line.

When the angle a of the feed paddle exceeds outside the range of 0–10°, in other words, the center of the paddle 14 is moved toward the downstream side from the tip portion of the cleaning blade 12 in the rotation direction of the photosensitive drum 2, that is, the upstream side from the center between the cleaning blade 12 and the recovery blade 13, cleaning performance is abruptly lowered with the result that a large blade linear load is required.

This tendency becomes more obvious as the arrangement angle c of the cleaning blade 12 is increased, in other words, as the cleaner 3 is positioned in the more upper portion above the photosensitive drum 2.

In the aforementioned conditions, the toner scraped by the cleaning blade 12 is accumulated on the tip portion of the cleaning blade 12. It follows that the pressure of the toner applied on a cleaning edge portion increases by the rotation of the photosensitive drum 2. Therefore, the toner is considered to easily remove from the cleaning blade 12.

On the other hand, if the linear load of the cleaning blade 12 is increased larger than 17.5 mM/mm, the blade 12 is more significantly curled up and the photosensitive layer of the photosensitive drum 2 is more severely scraped in the beginning. Therefore, the linear load must be set as low as possible.

From the foregoing, to prevent the accumulation of the toner on the tip portion of the cleaning blade 12 in order to maintain the cleaner in a good condition, it is necessary to arrange the feed paddle 14 in a position satisfying the equation as to the feed paddle angle a:

$$0 \leqq a \leqq b/2.$$

Since the feed paddle 14 is arranged at a position satisfying the equation as to the angle a: $0 \leqq a \leqq b/2$, as mentioned above in this embodiment, even if the cleaning apparatus 3 is placed above the photosensitive drum 2 in the image formation apparatus it is possible to scrape the magnetic toner remaining after the image transfer and simultaneously to recover the magnetic force by the feed paddle 14 satisfactorily.

It is therefore possible to prevent the accumulation of the toner on the tip portion of the cleaning blade 12 and maintain the cleaner in a good performance condition.

Furthermore, the remaining toner can be recovered efficiently. It is therefore possible to use the magnet for recovering the toner having a low magnetic force. Therefore, an inexpensive magnet can be used.

Furthermore, the linear load of the cleaning blade 12 can be reduced. Therefore, it is possible to prevent the curling-up of the blade in the beginning and to reduce the scraping of the photosensitive layer. As a result, the life span of the photosensitive drum can be extended.

Figure 5:
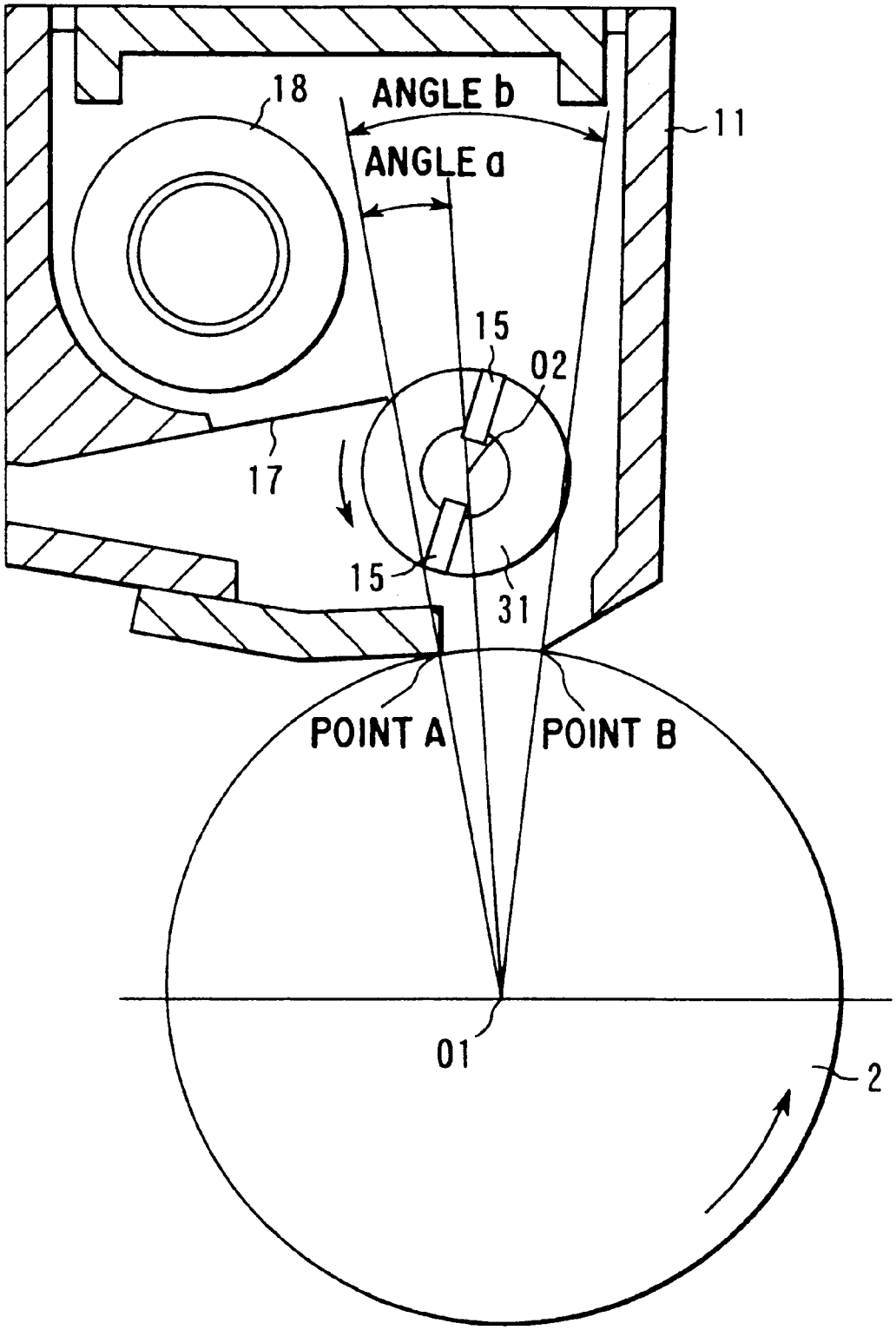
FIG. 5 is a view showing another magnetic rotational body.

FIG. 5 shows a cleaning apparatus according to another embodiment of the present invention.

The like reference symbols are used to designate the like structural elements corresponding to those shown in a first embodiment and any further explanation is omitted for brevity's sake.

In this embodiment, a feed roller 31 is used as the magnetic rotational body. The feed roller 31 is equipped with magnets 15, 15.

Similarly to the embodiment mentioned above, it is necessary to place the feed roller 31 to a position satisfying the equation as to an angle a:

$$0 \leqq a \leqq b/2.$$

Also in this embodiment, the same functional effects as in the first embodiment can be obtained.

What is claimed is:

1. A cleaning apparatus comprising:

a scraping member for removing a developing agent left on a rotatable drum-like image carrier, a tip portion of the scraping member being in contact with the image carrier;

a receiving member located at an upstream side of the scraping member in a rotation direction of the image carrier, for receiving developing agent from the scraping member in contact with the image carrier; and a rotational body for feeding and recovering the developing agent received by the receiving member by rotating the developing agent in a predetermined direction, the rotational body rotating in the same direction as the image carrier;

wherein, assuming that a rotation center of the image carrier is 01, a rotation center of the rotational body is 02, a contact point of the image carrier in contact with the scraping member is A, a contact point of the image carrier in contact with the receipt member is B, and further an angle between a line connecting the center 01 to the point A and a line connecting the center 01 to the center 02 is represented by a; and an angle between the line connecting the center 01 to the point A and a line connecting the center 01 and point B is represented by b, the rotational body is placed at a position satisfying an equation as to the angle a;

$$0 \leqq a \leqq b/2.$$

said contact points A and B are located vertically above a center of the image carrier and above a horizontal line which passes through a center of the image carrier, and contact points A and B sandwich a vertical line which passed through a center of the image carrier.

2. The cleaning apparatus according to claim 1, wherein the rotational body has a paddle form.

3. The cleaning apparatus according to claim 1, wherein the rotational body has a roller form.

4. The cleaning apparatus according to claim 1, wherein the developing agent is a magnetic toner.

5. The cleaning apparatus according to claim 1, further comprising an unloading auger for discharging the developing agent fed and recovered by the rotational body.

6. A cleaning apparatus comprising:

a scraper member for scraping a magnetic developing agent left on a rotatable image carrier by brining a tip portion of the scraping member in contact with the rotatable image carrier;

a receipt member located at an upstream side of the scraping member in a rotation direction of the image carrier, for receiving the magnetic developing agent scraped by the scraping member; and a magnetic rotational body for feeding an recovering the magnetic developing agent received by the receipt member by rotating the magnetic developing agent in a predetermined direction the magnetic rotational body rotating in the same direction as the image carrier;

wherein, assuming that a rotation center of the image carrier is 01, a rotation center of the magnetic rotational body is 02, a contact point of the image carrier in contact with the scraping member is A, a contact point of the image carrier in contact with the receipt member is B, and further an angle between a line connecting the center 01 to the point A and a line connecting the center 01 to the center 02 is represented by a; and an angle between the line connecting the center 01 to the point A and a line connecting A and a line connecting the center 01 and point B is represented by, b the magnetic rotational body is placed at a position satisfying an equation as to the angle a:

$$0 \leqq a \leqq b/2.$$

said contact points A and B are located above a horizontal line which passes through a center of the image carrier, and contact points A and B sandwich a vertical line which passes though a center of the image carrier and the horizontal line.

7. The cleaning apparatus according to claim 6, wherein a magnetic force of the magnetic rotational body is 400–500 gausses.

8. The cleaning apparatus according to claim 6, wherein the magnetic rotational body is spaced at a predetermined distance from the image carrier.

9. A cleaning method comprising the steps of:

scraping a developing agent left on a rotatable drum-like image carrier by a scraping member by bringing a tip portion of the scraping member in contact with the rotational image carrier;

receiving the developing agent scraped by the scraping member, using a receipt member which is positioned at an upstream side of the scraping member in a rotational direction of the image carrier by bringing a tip portion of the receipt member in contact with the image carrier; and recovering the developing agent received by the receipt member by feeding in a predetermined direction with the aid of a rotational body which rotates in the same direction as the image carrier, wherein, assuming that a rotation center of the image carrier is 01, a rotation center of the rotational body is 02, a contact point of the image carrier in contact with the scraping member is A, a contact point of the image carrier in contact with the receipt member is B, and further an angle between a line connecting the center 01 to the point A and a line connecting the center 01 to the center 02 is represented by a; and an angle between the line connecting the center 01 to the point A and a line connecting the center 01 and point B is represented by b, the rotational body is placed at a position satisfying an equation as to the angle a;

$$0 \leqq a \leqq b/2.$$

said contact points A and B are located above a horizontal line which passes through a center of the image carrier, and contact points A and B sandwich a vertical line which passes though a center of the image carrier and the horizontal line.

10. The cleaning method according to claim 9, wherein the rotational body has a paddle form.

11. The cleaning method according to claim 9, wherein the rotational body has a roller form.

12. The cleaning method according to claim 9, wherein the developing agent is a magnetic toner.

13. The cleaning method according to claim 9, further comprising an unloading auger for discharging the developing agent recovered by the rotational body.

14. An image forming apparatus having an image forming means for forming an electrostatic latent image on a rotatable drum-like image carrier, a developing means for developing an image by supplying a developing agent to said electrostatic latent image formed by said image forming means, a transfer means for transferring said image developed by said developing means to a material to be transferred, a fixing means for fixing the developed image, which is transferred by said transfer means, on said material, and a cleaning apparatus provided above said image carrier for removing the developing agent left on the image carrier after the transfer of said developed image, said cleaning apparatus comprising:

a scraping means for removing the developing agent left on said image carrier;

a receipt member located at an upstream side of the scraping member in a rotation direction of the image carrier, for receiving the developing agent bringing a tip portion of the scraping member in contact with the image carrier; and a rotational body for feeding and recovering the developing agent received by said receipt member by rotating the developing agent in a predetermined direction, the rotational body rotating in the same direction as the image carrier, wherein, assuming that a rotation center of the image carrier is 01, a rotation center of the rotational body is 02, a contact point of the image carrier in contact with the scraping member is A, a contact point of the image carrier in contact with the receipt member is B, and further an angle between a line connecting the center 01 to the point A and a line connecting the center 01 to the center 02 is represented by a; and an angle between the line connecting the center 01 to the point A and a line connecting the center 01 and point B is represented by b, the rotational body is placed at a position satisfying an equation as to the angle a;

$$0 \leqq a \leqq b/2.$$

said contact points A and B are located above a horizontal line which passes through a center of rotation of the image carrier, and contact points A and B respectively located on opposite sides of an essentially vertical line which passes through a center of the image carrier.

* * * * *